US010981228B2

(12) United States Patent
Yang et al.

(10) Patent No.: US 10,981,228 B2
(45) Date of Patent: Apr. 20, 2021

(54) POROUS ALUMINUM SINTERED COMPACT AND METHOD OF PRODUCING POROUS ALUMINUM SINTERED COMPACT

(71) Applicant: MITSUBISHI MATERIALS CORPORATION, Tokyo (JP)

(72) Inventors: Ji-bin Yang, Kitamoto (JP); Koichi Kita, Kitamoto (JP); Toshihiko Saiwai, Kitamoto (JP); Koji Hoshino, Kitamoto (JP); Jun Katoh, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 542 days.

(21) Appl. No.: 15/306,388

(22) PCT Filed: May 18, 2015

(86) PCT No.: PCT/JP2015/064179
§ 371 (c)(1),
(2) Date: Oct. 24, 2016

(87) PCT Pub. No.: WO2015/174541
PCT Pub. Date: Nov. 19, 2015

(65) Prior Publication Data

US 2017/0043398 A1 Feb. 16, 2017

(30) Foreign Application Priority Data

May 16, 2014 (JP) ..... JP2014-102834
May 14, 2015 (JP) ..... JP2015-099292

(51) Int. Cl.
*B22F 3/11* (2006.01)
*C22C 1/08* (2006.01)
(Continued)

(52) U.S. Cl.
CPC ..... *B22F 3/11* (2013.01); *B22F 1/025* (2013.01); *B22F 3/1109* (2013.01);
(Continued)

(58) Field of Classification Search
None
See application file for complete search history.

(56) References Cited

U.S. PATENT DOCUMENTS 3,301,671 A 1/1967 Storchheim
5,098,469 A 3/1992 Rezhets
(Continued)

FOREIGN PATENT DOCUMENTS

CA 1176490 A 10/1984
CN 1373233 A 10/2002
(Continued)

OTHER PUBLICATIONS

English machine translation of JP H06-330215, EPO, accessed Mar. 12, 2019.*
(Continued)

*Primary Examiner* — Xiaobei Wang
(74) *Attorney, Agent, or Firm* — Locke Lord LLP

(57) ABSTRACT

A high-quality porous aluminum sintered compact, which can be produced efficiently at a low cost; has an excellent dimensional accuracy with a low shrinkage ratio during sintering; and has sufficient strength, and a method of producing the porous aluminum sintered compact are provided.

The porous aluminum sintered compact is the porous aluminum sintered compact (10) that includes aluminum substrates (11) sintered to each other. The junction (15), in which the aluminum substrates (11) are bonded to each other, includes the Ti—Al compound (16) and the Mg oxide (17). It is preferable that the pillar-shaped protrusions pro-
(Continued)

jecting toward the outside are formed on outer surfaces of the aluminum substrates (11), and the pillar-shaped protrusions include the junction (15).

5 Claims, 7 Drawing Sheets

(51) Int. Cl.

| | |
|---|---|
| ***C22C 47/14*** | (2006.01) |
| ***C22C 21/00*** | (2006.01) |
| ***C22C 32/00*** | (2006.01) |
| ***B22F 1/02*** | (2006.01) |
| ***C22C 1/04*** | (2006.01) |

(52) U.S. Cl.
CPC ..... *C22C 1/0416* (2013.01); *C22C 1/08* (2013.01); *C22C 21/00* (2013.01); *C22C 32/0036* (2013.01); *C22C 47/14* (2013.01); *B22F 2998/10* (2013.01)

(56) References Cited

U.S. PATENT DOCUMENTS

| | | | | |
|---|---|---|---|---|
| 5,597,665 | A * | 1/1997 | Harada | B22F 3/1103 429/235 |
| 5,788,737 | A | 8/1998 | Wakiyama et al. | |
| 2009/0165651 | A1 * | 7/2009 | Burgess | B01D 39/2044 95/284 |
| 2012/0094142 | A1 | 4/2012 | Hoshino et al. | |
| 2013/0305673 | A1 | 11/2013 | Zeller | |

FOREIGN PATENT DOCUMENTS

| | | | |
|---|---|---|---|
| CN | 102162052 | A | 8/2011 |
| CN | 102365143 | A | 2/2012 |
| CN | 102438778 | A | 5/2012 |
| CN | 102458725 | A | 5/2012 |
| CN | 102776418 | A | 11/2012 |
| CN | 103667762 | A | 3/2014 |
| EP | 1402978 | A1 | 3/2004 |
| EP | 2939762 | A1 | 11/2015 |
| EP | 3144082 | A1 | 3/2017 |
| EP | 3150305 | A1 | 4/2017 |
| EP | 3165864 | A1 | 5/2017 |
| EP | 3213839 | A1 | 9/2017 |
| JP | 48-037488 | A | 6/1973 |
| JP | 56-077301 | A | 6/1981 |
| JP | 56-149363 | A | 11/1981 |
| JP | 61-048566 | B2 | 10/1986 |
| JP | H03-110045 | A | 5/1991 |
| JP | 06-330215 | A1 | 11/1994 |
| JP | 08-325661 | A | 12/1996 |
| JP | 08-325662 | A | 12/1996 |
| JP | 2006-028616 | A | 2/2006 |
| JP | 2008-020864 | A | 1/2008 |
| JP | 1303649 | B2 | 5/2009 |
| JP | 2009-228025 | A | 10/2009 |
| JP | 2009-256788 | A | 11/2009 |
| JP | 2010-500469 | A | 1/2010 |
| JP | 2010-116623 | A | 5/2010 |
| JP | 2010-255089 | A | 11/2010 |
| JP | 2010-280951 | A | 12/2010 |
| JP | 2011-023430 | A | 2/2011 |
| JP | 2011-049023 | A | 3/2011 |
| JP | 2011-077269 | A | 4/2011 |
| JP | 2011-214049 | A | 10/2011 |
| JP | 2011-253645 | A | 12/2011 |
| JP | 2012-119465 | A | 6/2012 |
| JP | 2014-025148 | A | 2/2014 |
| JP | 2014-031585 | A | 2/2014 |
| JP | 2014-141733 | A | 8/2014 |
| JP | 2014-194074 | A | 10/2014 |
| JP | 2014-194075 | A | 10/2014 |
| WO | 2008/017111 | A1 | 2/2008 |
| WO | 2010/116679 | A1 | 10/2010 |
| WO | 2014/133077 | A1 | 9/2014 |
| WO | 2014/133079 | A1 | 9/2014 |

OTHER PUBLICATIONS

English translation of H08-325661, EPO, accessed Aug. 22, 2019.*
Office Action dated Nov. 27, 2018, issued for the Japanese patent application No. 2015-099292 and English translation thereof.
International Search Report dated Jun. 30, 2015, issued for PCT/JP2015/064179 and English translation thereof.
Office Action dated May 25, 2017, issued for the Chinese patent application No. 201580013707.9 and English translation thereof.
Peisheng Liu, "Introduction to Cellular Materials" Beijing: Tsinghua University Press, Sep. 30, 2004, pp. 138-140 and English translation thereof. (cited in the Sep. 11, 2018 Decision of Rejection issued for CN201580013707.9).
Decision of Rejection dated Sep. 11, 2018, issued for the Chinese patent application No. 201580013707.9 and a partial English translation of the search report.
Search Report dated Dec. 4, 2017, issued for the European patent application No. 15792389.7.
International Search Report dated Jun. 30, 2015, issued for PCT/JP2015/064180 and English tarnslation thereof.
Office Action dated Apr. 6, 2017, issued for the Chinese patent application No. 201580015338.7 and English translation thereof.
Search Report dated Dec. 15, 2017, issued for the European patent application No. 157919853.
Office Action dated Mar. 2, 2018, issued for the Chinese patent application No. 201580015338.7 and English translation thereof.
Office Action dated Sep. 3, 2018, issued for the Chinese patent application No. 201580015338.7 and a partial English translation of the search report.
Office Action dated Dec. 11, 2018, issued for the Japanese patent application No. 2015-099293 and English translation thereof.
International Search Report dated Dec. 8, 2015, issued for PCT/JP2015/080358 and English Translation thereof.
Office Action dated Jul. 18, 2018, issued for the Chinese Patent Application No. 201580058206.2 and a partial translation of the search report.
Search Report dated Mar. 22, 2018, issued for the European Patent Application No. 15855571.4.
Merriam-Webster, "Definition of include", accessed Jan. 23, 2018, https://www.merriam-webster.com/dictionary/include.
Office Action dated May 22, 2018, issued for U.S. Appl. No. 15/302,374.
Office Action dated Sep. 26, 2018, issued for U.S. Appl. No. 15/302,374.
Office Action dated Apr. 2, 2019, issued for U.S. Appl. No. 15/302,374.

* cited by examiner

POROUS ALUMINUM SINTERED COMPACT AND METHOD OF PRODUCING POROUS ALUMINUM SINTERED COMPACT

TECHNICAL FIELD

The present invention relates to a porous aluminum sintered compact, in which aluminum substrates are sintered to each other, and a method of producing a porous aluminum sintered compact.

BACKGROUND ART

The above-described porous aluminum sintered compact is used as electrodes and current collectors in various batteries; parts of heat exchangers; sound deadening parts; filters; shock-absorbing parts; and the like, for example.

Conventionally, these porous aluminum sintered compacts are produced by methods disclosed in Patent Literatures 1 to 5 (PTLs 1 to 5), for example.

In PTL 1, a porous aluminum sintered compact is produced as explained below. First, a mixture formed by mixing an aluminum powder; paraffin wax grains; and a binder, is shaped into a sheet-shaped form and then, subjected to natural drying. Then, the wax grains are removed by dipping the dried sheet in an organic solvent. Then, the sheet is subjected to drying, defatting, and sintering to obtain the porous aluminum sintered compact.

In PTLs 2-4, porous aluminum sintered compacts are produced by forming viscous compositions by mixing aluminum powders, sintering additives including titanium, binders, plasticizers, and organic solvents; foaming after shaping the viscous compositions; and then heat-sintering under a non-oxidizing atmosphere.

In PTL 5, a porous aluminum sintered compact is produced by mixing a base powder made of aluminum, an Al alloy powder including a eutectic element for forming bridging, and the like; and heat-sintering the obtained mixture under a hydrogen atmosphere or in a mixed atmosphere of hydrogen and nitrogen. The porous aluminum sintered compact has a structure in which grains of the base powder made of aluminum are connected to each other by bridge parts made of a hypereutectic organization.

CITATION LIST

Patent Literature

PTL 1: Japanese Unexamined Patent Application, First Publication No. 2009-256788 (A)

PTL 2: Japanese Unexamined Patent Application, First Publication No. 2010-280951 (A)

PTL 3: Japanese Unexamined Patent Application, First Publication No. 2011-023430 (A)

PTL 4: Japanese Unexamined Patent Application, First Publication No. 2011-077269 (A)

PTL 3: Japanese Unexamined Patent Application, First Publication No. H08-325661 (A)

SUMMARY OF INVENTION

Technical Problem

In the porous aluminum sintered compact and the method of producing the porous aluminum sintered compact described in PTL 1, there is a problem that obtaining one with a high porosity is hard. In addition, there are problems that bonding of aluminum substrates to each other is inhibited by strong oxide films formed on the surfaces of the aluminum substrates in the case where the aluminum substrates are sintered to each other; and a porous aluminum sintered compact with sufficient strength cannot be obtained.

In the porous aluminum sintered compacts and the methods of producing the porous aluminum sintered compact described in PTLs 2-4, there is a problem that the porous aluminum sintered compacts cannot be produced efficiently since the viscous compositions are subjected to shaping and foaming. In addition, there are problems that it takes a long time for the binder removal process since the viscous compositions contain large amounts of binders; the shrinkage ratios of the compacts increase during sintering; and a porous aluminum sintered compact having excellent dimensional accuracy cannot be obtained.

In addition, in the porous aluminum sintered compact and the method of producing the porous aluminum sintered compact described in PTL 5, the porous aluminum sintered compact has the structure in which grains of the base powder made of aluminum are connected to each other by bridge parts made of a hypereutectic organization. In this bridge part, the low-melting temperature Al alloy powder having a eutectic composition is melted and a liquid phase is formed; and the bridge part is formed by this liquid phase being solidified between grains of the base powder. Therefore, it is hard to obtain one with high porosity.

In addition, in the porous aluminum sintered compacts described in PTLs 1-5, strength is not sufficient; and they are prone to be broken. Because of this, they have to be treated with special cautious measures during transportation and machining. Particularly, in a porous aluminum sintered compact with high porosity, there is a tendency that strength is further reduced.

The present invention is made under the circumstances explained above. The purpose of the present invention is to provide a high-quality porous aluminum sintered compact, which can be produced efficiently at a low cost; has an excellent dimensional accuracy with a low shrinkage ratio during sintering; and has sufficient strength, and a method of producing a porous aluminum sintered compact.

Solution to Problem

In order to achieve the purpose by solving the above-mentioned technical problems, the present invention has aspects explained below. An aspect of the present invention is a porous aluminum sintered compact including a plurality of aluminum substrates sintered to each other, wherein a junction, in which the plurality of aluminum substrates are bonded to each other, includes a Ti—Al compound and a Mg oxide.

According to the porous aluminum sintered compact configured as described above, which is an aspect of the present invention, diffusion migration of aluminum is suppressed since the junction of the aluminum substrates includes the Ti—Al compound. Therefore, voids can be maintained between the aluminum substrate; and a porous aluminum sintered compact having high porosity can be obtained.

In addition, the junction includes the Mg oxide. It is understood that this Mg oxide is formed by a part of oxide films formed on the aluminum substrates being reduced by Mg. Accordingly, because of reduction of oxide films on the surfaces of the aluminum substrates by Mg, a large number of junctions between the aluminum substrates become easier to be formed. As a result, strength of the porous aluminum sintered compact can be improved.

In the porous aluminum sintered compact, which is an aspect of the present invention, a plurality of pillar-shaped protrusions projecting toward an outside may be formed on outer surfaces of the aluminum substrates, and the pillar-shaped protrusions may include the junction.

In this case, the porous aluminum sintered compact has a structure in which the aluminum substrates are bonded to each other through the pillar-shaped protrusions formed on the outer surfaces of the aluminum substrates. Thus, a porous aluminum sintered compact having high porosity can be obtained without performing the step of foaming or the like separately. Therefore, the porous aluminum sintered compact can be produced efficiently at low cost.

Furthermore, the porous aluminum sintered compact, which has an excellent dimensional accuracy with a low shrinkage ratio during sintering and sufficient strength, can be obtained, since there is a less amount of binders between the aluminum substrate unlike the viscous compositions.

In the porous aluminum sintered compact, which is an aspect of the present invention, the aluminum substrates may be made of any one of or both of aluminum fibers and an aluminum powder.

In the case where the aluminum fibers are used as the aluminum substrates, the voids are likely to be held during bonding of the aluminum fibers through the pillar-shaped protrusions; and porosity tends to be increased. Accordingly, the porosity of the porous aluminum sintered compact can be controlled by: using the aluminum fibers and the aluminum powder as the aluminum substrates; and adjusting their mixing ratios.

In the porous aluminum sintered compact, which is an aspect of the present invention, a porosity of the porous aluminum sintered compact may be in a range of 30% or more and 90% or less.

In the porous aluminum sintered compact configures as described above, it is possible to provide a porous aluminum sintered compact having an optimal porosity depending on the application since the porosity is controlled in the range of 30% or more and 90% or less.

Other aspect of the present invention is a method of producing a porous aluminum sintered compact including a plurality of aluminum substrates sintered to each other, the method including the steps of: forming an aluminum raw material for sintering by adhering a titanium powder, which is made of any one of or both of a titanium metal powder and a titanium hydride powder, and a magnesium powder on outer surfaces of the aluminum substrates; spreading the aluminum raw material for sintering on a holder; and sintering the aluminum raw material held on the holder by heating, wherein the plurality of the aluminum substrates are bonded through a junction including a Ti—Al compound and the a Mg oxide.

In the method of producing a porous aluminum sintered compact configured as described above, the porous aluminum sintered compact is produced by sintering the aluminum raw material for sintering in which a titanium powder, which is made of any one of or both of a titanium metal powder and a titanium hydride powder, and a magnesium powder are adhered on the outer surfaces of the aluminum substrates.

In the case where the above-described aluminum raw material for sintering is heated to near the melting point of the aluminum substrates in the step of sintering, the aluminum substrates are melted. However, oxide films are formed on the surfaces of the aluminum substrates; and the melted aluminum is held by the oxide films. As a result, the shapes of the aluminum substrates are maintained. In addition, diffusion migration of aluminum is suppressed since the aluminum substrates are bonded to each other through the junctions including the Ti—Al compounds. Accordingly, voids between the aluminum substrate can be maintained; and a porous aluminum sintered compact having high porosity can be obtained.

In addition, the junction includes the Mg oxide. It is understood that this Mg oxide is formed by a part of oxide films formed on the aluminum substrates being reduced by Mg. Accordingly, because of reduction of oxide films on the surfaces of the aluminum substrates by Mg, a large number of junctions between aluminum substrates become easier to be formed. As a result, strength of the porous aluminum sintered compact can be improved.

In the method of producing a porous aluminum sintered compact, which is other aspect of the present invention, the junction may formed on a plurality of pillar-shaped protrusions projecting toward an outside from outer surfaces of the aluminum substrates.

In the part where the titanium powder is adhered among the outer surfaces of the aluminum substrates, the oxide files are destroyed by the reaction with titanium; the melted aluminum inside spouts out; and the spouted out melted aluminum forms a high-melting point compound by reacting with titanium to be solidified. Because of this, the pillar-shaped protrusions projecting toward the outside are formed on the outer surfaces of the aluminum substrates.

Then, though the pillar-shaped protrusions formed on the outer surfaces of the aluminum substrates, the aluminum substrates are bonded to each other. Thus, a porous aluminum sintered compact having high porosity can be obtained without performing the step of foaming or the like separately. Therefore, the porous aluminum sintered compact can be produced efficiently at low cost.

In addition, since the magnesium powder is adhered on the surfaces of the aluminum substrates, a part of the oxide films on the surfaces of the aluminum substrates is reduced by magnesium, a large number of the pillar-shaped protrusions become easier to be formed. As a result, strength of the porous aluminum sintered compact can be significantly improved.

Furthermore, the porous aluminum sintered compact, which has an excellent dimensional accuracy with a low shrinkage ratio during sintering and sufficient strength, can be obtained, since there is a less amount of binders between the aluminum substrate unlike the viscous compositions.

In addition, filling up of the voids between the aluminum substrate by the melted aluminum can be prevented, since the liquid phase of the melted aluminum is solidified by formation of the Ti—Al compound. Thus, a porous aluminum sintered compact having high porosity can be obtained.

In the method of producing a porous aluminum sintered compact, which is other aspect of the present invention, a content amount of the titanium powder in the aluminum raw material for sintering may be set in a range of 0.01 mass % or more and 20 mass % or less, and a content amount of the magnesium powder in the aluminum raw material for sintering may be set in a range of 0.01 mass % or more and 5 mass % or less step of forming an aluminum raw material for sintering.

In this case, since the content amount of the titanium powder is set to 0.01 mass % or more and the content amount of the magnesium powder is set to 0.01 mass % or more, the aluminum substrates can be bonded to each other reliably; and a porous aluminum sintered compact having sufficient strength can be obtained. In addition, since the content amount of the titanium powder is set to 20 mass % or less, and the content amount of the magnesium powder is set to 5 mass % or less, the filling up of the voids between the aluminum substrate by the melted aluminum can be prevented; and a porous aluminum sintered compact having high porosity can be obtained.

In the method of producing a porous aluminum sintered compact, which is other aspect of the present invention, the step of forming an aluminum raw material for sintering may include the steps of mixing the aluminum substrates; and the titanium powder and the magnesium powder, in a presence of a binder; and drying a mixture obtained in the step of mixing.

In the method of producing a porous aluminum sintered compact as configured above, the step of forming an aluminum raw material for sintering includes the steps of: mixing the aluminum substrates; and the titanium powder and the magnesium powder, in a presence of a binder; and drying a mixture obtained in the step of mixing. Thus, the titanium powder and the magnesium powder are dispersedly adhered on the surfaces of the aluminum substrates to produce the above-described aluminum raw material for sintering.

Advantageous Effects of Invention

According to the present invention, a high-quality porous aluminum sintered compact, which can be produced efficiently at a low cost; has an excellent dimensional accuracy with a low shrinkage ratio during sintering; and has sufficient strength, and a method of producing the porous aluminum sintered compact are provided.

DESCRIPTION OF EMBODIMENTS

The porous aluminum sintered compact 10, which is an embodiment of the present invention, is explained below in reference to the attached drawings.

Figure 1:
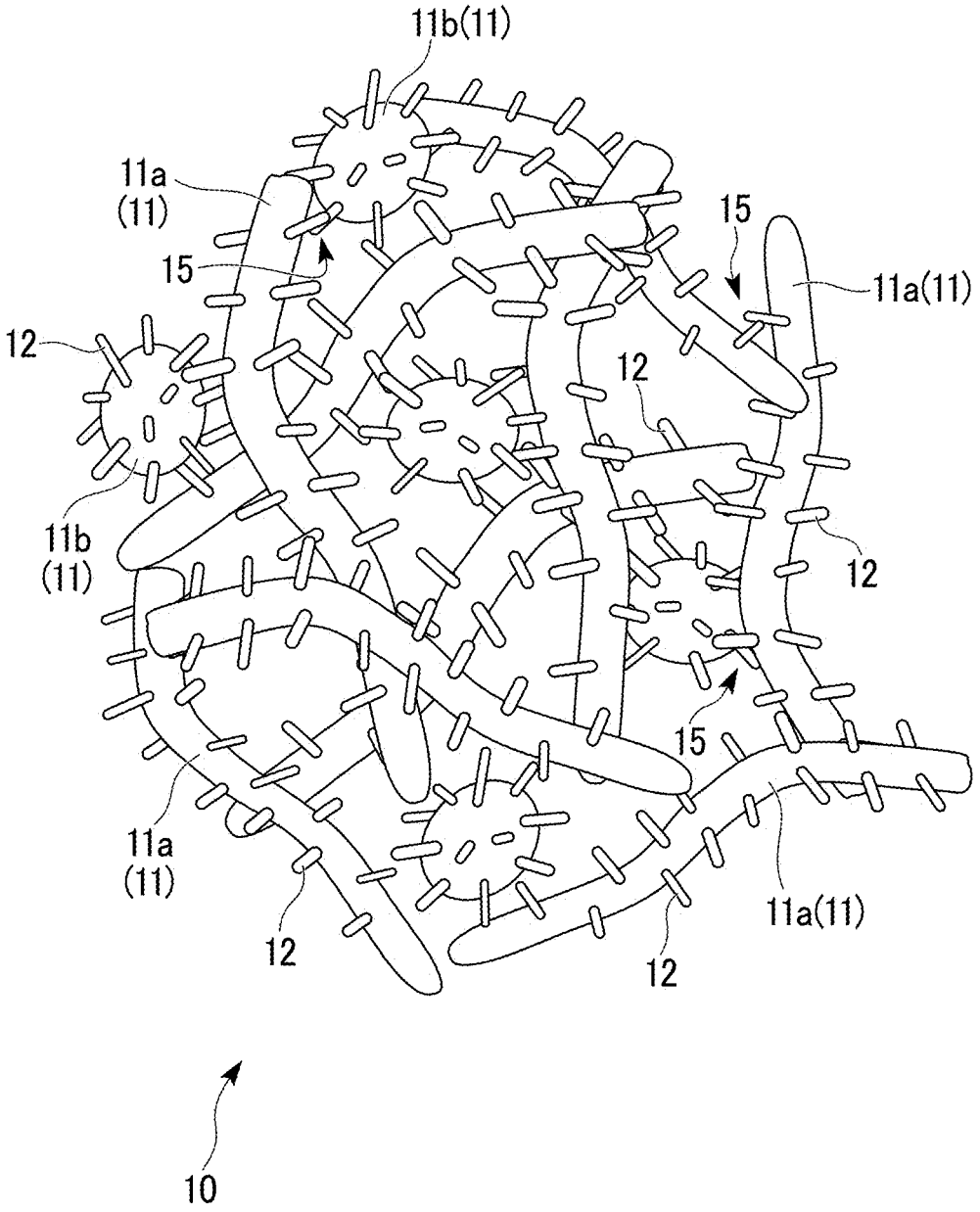
FIG. 1 is an enlarged schematic view of the porous aluminum sintered compact of an embodiment related to the present invention.

The porous aluminum sintered compact 10, which is an embodiment of the present invention, is shown in FIG. 1. As shown in FIG. 1, the porous aluminum sintered compact 10 of the present embodiment is what the aluminum substrates 11 are integrally combined by sintering; and the porosity of the porous aluminum sintered compact 10 is set to the range of 10% or more and 90% or less.

In the present embodiment, the aluminum fibers 11*a* and the aluminum powder 11*b* are used as the aluminum substrates 11 as shown in FIG. 1.

The porous aluminum sintered compact 10 has the structure, in which the pillar-shaped protrusions 12 projecting toward the outside are formed on the outer surfaces of the aluminum substrates 11 (the aluminum fibers 11*a* and the aluminum powder 11*b*); and the aluminum substrates 11 (the aluminum fibers 11*a* and the aluminum powder 11*b*) are bonded to each other through the pillar-shaped protrusions 12. As shown in FIG. 1, the junctions 15 between the aluminum substrates 11, 11 include: a part in which the pillar-shaped protrusions 12, 12 are bonded to each other; a part in which the pillar-shaped protrusion 12 and the side surface of the aluminum substrate 11 are bonded to each other; and a part in which the side surfaces of the aluminum substrates 11, 11 are bonded to each other.

Figure 2:
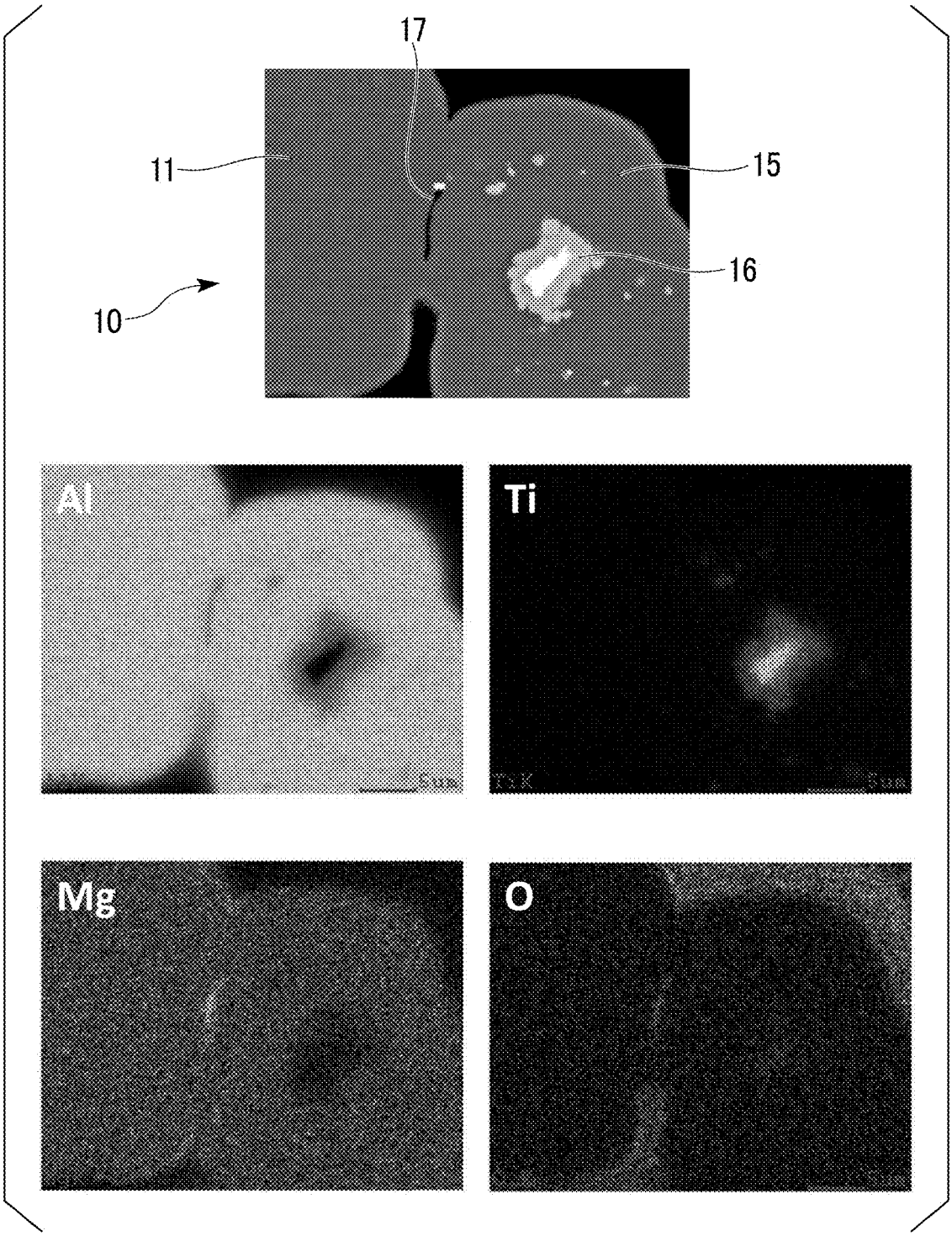
FIG. 2 is a diagram showing an SEM observation and composition analysis results of the junction between the aluminum substrate of the porous aluminum sintered compact shown in FIG. 1.

The junction 15 of the aluminum substrates 11, 11 bonded to each other through the pillar-shaped protrusion 12, includes the Ti—Al compound 16 and the Mg oxide 17 as shown FIG. 2. The Ti—Al compound 16 is a compound of Ti and Al in the present embodiment as shown in the analysis results of FIG. 2. More specifically, it is $Al_3Ti$ intermetallic compound. In addition, the Mg oxide 17 locates at the surface layer of the junction 15 and the aluminum substrate 11. In other words, the aluminum substrates 11, 11 are bonded to each other in the part where the Ti—Al compound 16 and the Mg oxide 17 exist in the present embodiment.

Figure 4:
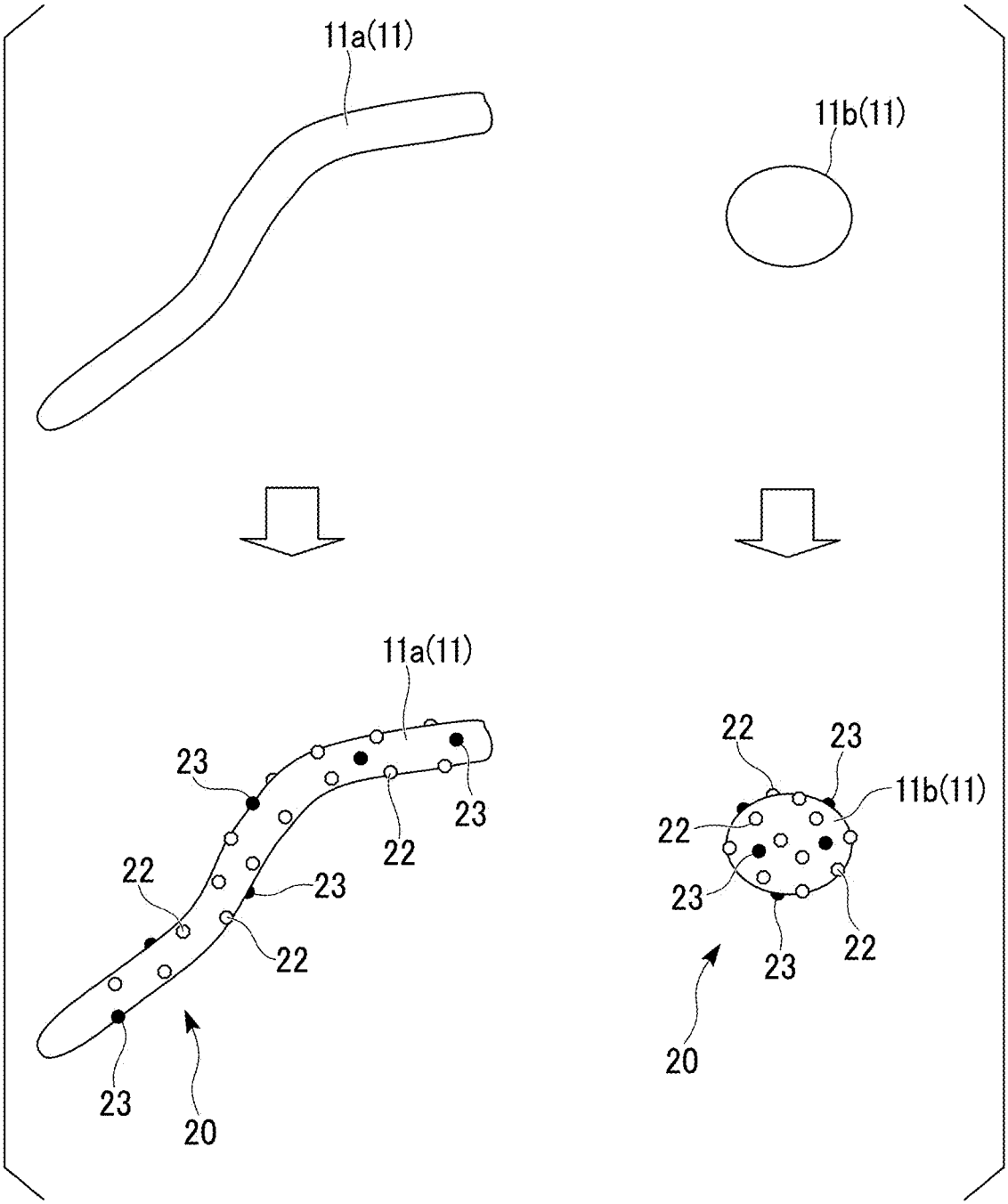
FIG. 4 is an explanatory diagram of the aluminum raw material for sintering in which the titanium powder and the magnesium powder are adhered on the surfaces of the aluminum substrates.

Next, the aluminum raw material for sintering 20, which is the raw material of the porous aluminum sintered compact 10 of the present embodiment, is explained. The aluminum raw material for sintering 20 includes: the aluminum substrate 11; and the titanium powder grains 22 and the magnesium powder grains 23, both of which are adhered on the outer surface of the aluminum substrate 11, as shown in FIG. 4. As the titanium powder grains 22, any one or both of the metal titanium powder grains and the titanium hydride powder grains can be used. As the magnesium oxide grain 23, the metal magnesium powder grains are used.

In the aluminum raw material for sintering 20, the content amount of the titanium powder grains 22 is set to the range of 0.01 mass % or more and 20 mass % or less. In the present embodiment, it is set to 5 mass %.

The grain size of the titanium powder grains 22 is set to the range of 1 μm or more and 50 μm or less. Preferably, it is set to 5 μm or more and 30 μm or less. The titanium hydride powder grains can be set to a value finer than that of the metal titanium powder grains. Thus, in the case where the grain size of the titanium powder grains 22 adhered on the outer surface of the aluminum substrate 11 is set to a fine value, it is preferable that the titanium hydride powder grains are used.

Moreover, it is preferable that the distance between the titanium powder grains 22, 22 adhered on the outer surface of the aluminum substrate 11 is set to the range of 5 μm or more and 100 μm or less.

In addition, in the aluminum raw material for sintering 20, the content amount of the magnesium powder grains 23 is set to the range of 0.01 mass % or more and 5 mass % or less. In the present embodiment, it is set to 1.0 mass %.

The grain size of the magnesium powder grains 23 is set to the range of 20 μm or more and 200 μm or less. Preferably, it is set to the range of 20 μm or more and 80 μm or less.

As the aluminum substrate 11, the aluminum fibers 11*a* and the aluminum powder 11*b* are used as described above. As the aluminum powder 11*b*, an atomized powder can be used.

The fiber diameter of the aluminum fiber 11*a* is set to the range of 40 μm or more and 1000 μm or less. Preferably, it is set to the range of 50 μm or more and 500 μm or less. The fiber length of the aluminum fiber 11*a* is set to the range of 0.2 mm or more and 100 mm or less. Preferably, it is set to the range of 1 mm or more and 50 mm or less.

The aluminum fiber 11*a* is made of pure aluminum or an aluminum alloy, for example; and the ratio L/R of the length L to the fiber diameter R may be set to the range of 4 or more and 2500 or less. The aluminum fiber 11*a* can be obtained by the step of forming the aluminum raw material for sintering, in which any one or both of the Mg powder and the Mg alloy powder are adhered on its outer surface and the aluminum raw material for sintering is formed, for example. In the step of sintering, the aluminum raw material for sintering can be sintered at the temperature range of 590° C. to 665° C. under an inert gas atmosphere.

In the case where the fiber diameter R of the aluminum fiber 11*a* is less than 20 μm, sufficient sintered strength might not be obtained due to too small junction area of the aluminum fibers. On the other hand, in the case where the fiber diameter R of the aluminum fiber 11*a* is more than 1000 μm, sufficient sintered strength might not be obtained due to lack of contact points of the aluminum fibers.

Because of the reasons described above, in the porous aluminum sintered compact 10 of the present embodiment, the fiber diameter R of the aluminum fiber 11*a* is set to the range of 20 μm or more and 1000 μm or less. In the case where more improved sintered strength is needed, it is preferable that the fiber diameter of the aluminum fiber ha is set to 50 μm or more; and the fiber diameter of the aluminum fiber 11*a* is set to 500 μm or less.

In the case where the ratio L/R of the length L of the aluminum fiber 11*a* to the fiber diameter R is less than 4, it becomes harder to keep the bulk density DP in a stacking arrangement at 50% of the true density DT of the aluminum fiber or less in the method of producing the porous aluminum sintered compact. Thus, obtaining the porous aluminum sintered compact 10 having high porosity could be difficult. On the other hand, in the case where the ratio L/R of the length L of the aluminum fiber 11*a* to the fiber diameter R is more than 2500, it becomes impossible to disperse the aluminum fibers 11*a* evenly. Thus, obtaining the porous aluminum sintered compact 10 having uniform porosity could be difficult.

Because of the reasons described above, in the porous aluminum sintered compact 10 of the present embodiment, the ratio L/R of the length L of the aluminum fiber 11*a* to the fiber diameter R is set to the range of 4 or more and 2500 or less. In the case where more improved porosity is needed, it is preferable that the ratio L/R of the length L to the fiber diameter R is set to 10 or more. In addition, in order to obtain the porous aluminum sintered compact 10 having more uniform porosity, it is preferable that the ratio L/R of the length L to the fiber diameter R is set to 500 or more.

The grain size of the aluminum powder 11*b* is set to the range of 20 mm or more and 300 μm or less. Preferably, it is set to the range of 20 μm or more and 100 μm or less.

As the aluminum fiber 11*a*, any one of the pure aluminum and the general aluminum alloys can be suitably used.

In the case where an aluminum alloy is used as the aluminum fiber 11*a*, the A3003 alloy (Al—0.6 mass % Si—0.7 mass % Fe—0.1 mass % Cu—1.5 mass % Mn—0.1 mass % Zn alloy), the A5052 alloy (Al—0.25 mass % Si—0.40 mass % Fe—0.10 mass % Cu—0.10 mass % Mn—2.5 mass % Mg—0.2 mass % Cr—0.1 mass % Zn alloy) as defined in JIS, and the like can be named for example.

As the aluminum powder 11*b*, the pure aluminum powder and/or an aluminum alloy powder may be used. For example, the powder made of JIS A3003 alloy or the like can be used.

The shape of the aluminum fiber 11*a* can be selected arbitrary, such as a liner shape, a curved shape, and the like. However, if ones subjected to a predetermined shape-added processing, such as torsion processing, bending processing, and like, on at least a part of the aluminum fibers 11*a* were used, the shapes of void between the aluminum fibers 11*a* would be formed three-dimensionally and isotopically. As a result, isotropy of various characteristics of the porous aluminum sintered compact, such as the heat-transfer property and the like, is improved. Thus, it is preferable.

In addition, the porosity can be controlled by adjusting the mixing rate of the aluminum fibers 11*a* and the aluminum powder 11*b*. More specifically, the porosity of the porous aluminum sintered compact can be improved by increasing the ratio of the aluminum fiber 11*a*. Because of this, it is preferable that the aluminum fibers 11*a* are used as the aluminum substrates 11. In the case where the aluminum powder 11*b* is mixed in, it is preferable that the ratio of the aluminum powder 11*b* in the aluminum substrates is set to 15 mass % or less.

Figure 3:
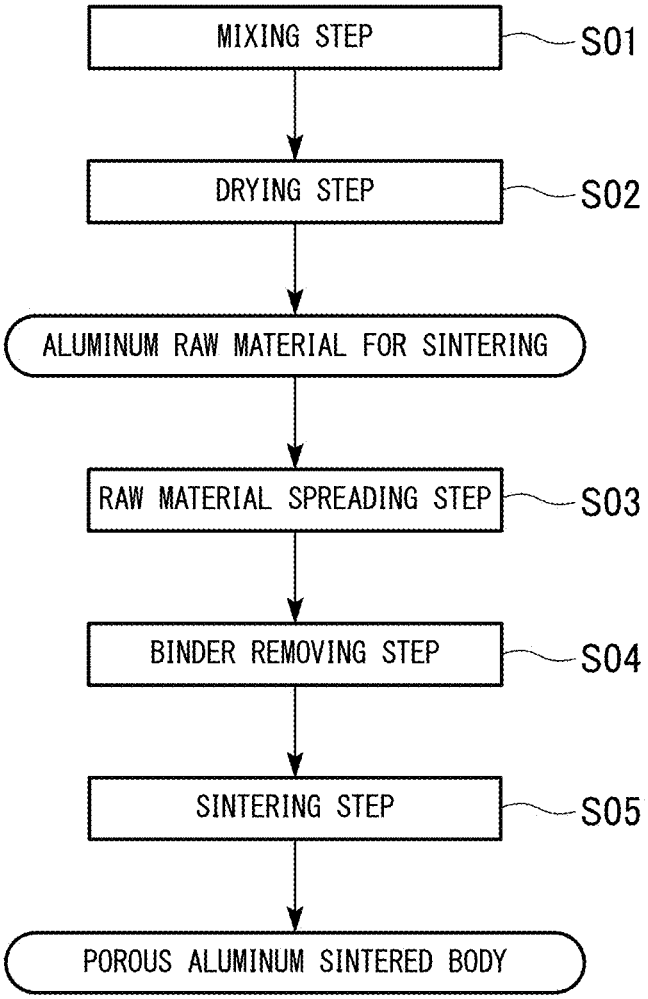
FIG. 3 is a flow diagram showing an example of the method of producing the porous aluminum sintered compact shown in FIG. 1.

Next, the method of producing the porous aluminum sintered compact 10 of the present embodiment is explained in reference to the flow diagram in FIG. 3 and the like.

First, the aluminum raw material for sintering 20, which is the raw material of the porous aluminum sintered compact 10 of the present embodiment, is produced as shown in FIG. 3.

The above-described aluminum substrates 11, the titanium powder, and the magnesium powder are mixed at room temperature (the mixing step S01). At this time, the binder solution is sprayed on. As the binder, what is burned and decomposed during heating at 500° C. in the air is preferable. More specifically, using an acrylic resin or a cellulose-based polymer material is preferable. In addition, various solvents such as the water-based, alcohol-based, and organic-based solvents can be used as the solvent of the binder.

In the mixing step S01, the aluminum substrates 11, the titanium powder, and the magnesium powder are mixed by various mixing machine, such as an automatic mortar, a pan type rolling granulator, a shaker mixer, a pot mill, a high-speed mixer, a V-shaped mixer, and the like, while they are fluidized.

Next, the mixture obtained in the mixing step S01 is dried (the drying step S02). By the mixing step S01 and the drying step S02, the titanium powder grains 22 and the magnesium powder grain 23 are dispersedly adhered on the surfaces of the aluminum substrates 11 as shown in FIG. 4; and the aluminum raw material for sintering 20 in the present embodiment is produced. It is preferable that the titanium powder grains 22 are dispersed in such a way that the distance between the titanium powder grains 22, 22 adhered on the outer surfaces of the aluminum substrates 11 is set to the range of 5 μm or more and 100 μm or less.

Next, the porous aluminum sintered compact 10 is produced by using the aluminum raw material for sintering 20 obtained as described above.

Figure 5:
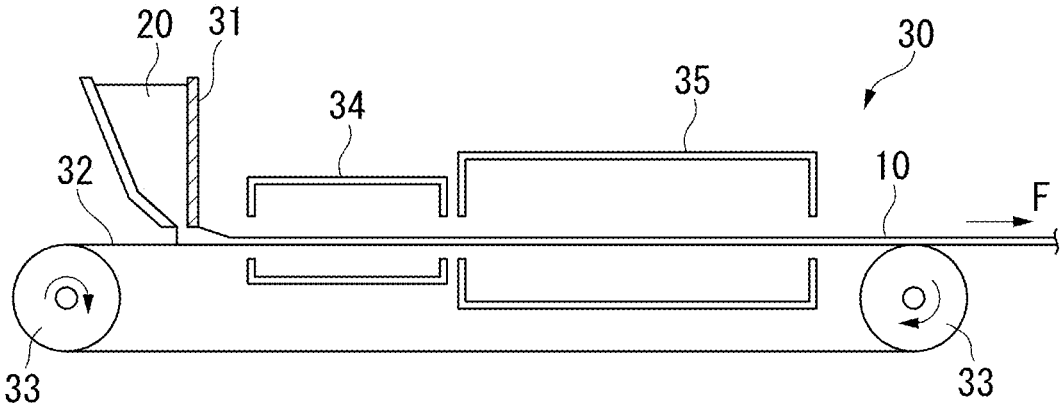
FIG. 5 is a schematic illustration of the continuous sintering apparatus for producing the porous aluminum sintered compact in a sheet shape.

In the present embodiment, the porous aluminum sintered compact 10 in the long sheet shape of 300 mm of width; 1-5 mm of thickness; and 20 m of length, is produced, for example, by using the continuous sintering apparatus 30 shown in FIG. 5.

This continuous sintering apparatus 30 has: the powder spreading device 31 spreading the aluminum raw material for sintering 20 evenly; the carbon sheet 32 holding the aluminum raw material for sintering 20 supplied from the powder spreading device 31; the transport roller 33 driving the carbon sheet 32; the degreasing furnace 34 removing the binder by heating the aluminum raw material for sintering 20 transported with the carbon sheet 32; and the sintering furnace 35 sintering the binder-free aluminum raw material for sintering 20 by heating.

First, the aluminum raw material for sintering 20 is spread toward the upper surface of the carbon sheet 32 from the powder spreading device 31 (the raw material spreading step S03).

The aluminum raw material for sintering 20 spread on the carbon sheet 32 spreads in the width direction of the carbon sheet 32 during moving toward the traveling direction F to be uniformed and formed into a sheet shape. At this time, load is not placed upon. Thus, voids are formed between the aluminum substrates 11 in the aluminum raw material for sintering 20. In the present embodiment, a shape-added processing, such as torsion processing, bending processing, and like, is performed on the aluminum fibers 11 in the aluminum substrates 11 used for the aluminum raw material for sintering 20. Thus, three dimensional and isotropic voids are maintained between the stacked aluminum raw materials for sintering 20.

Next, the aluminum raw material for sintering 20, which is shaped into a sheet-shape on the carbon sheet 32, is inserted in the degreasing furnace 34 with the carbon sheet 32; and the binder is removed by being heated at a predetermined temperature (the binder removing step S04).

In the binder removing step S04, the aluminum raw material for sintering 20 is maintained at 350° C. to 500° C. for 0.5 to 5 minutes in the air atmosphere; and the binder in the aluminum raw material for sintering 20 is removed. In the present embodiment, the binder is used only for adhering the titanium powder grains 22 and the magnesium powder grains 23 on the outer surfaces of the aluminum substrates 11 as described above. Thus, the content amount of the binder is extremely low compared to the viscous compositions; and the binder can be removed sufficiently in a short time.

Next, the aluminum raw material for sintering 20 free of the binder is inserted in the sintering furnace 35 with the carbon sheet 32 and sintered by being heated at a predetermined temperature (the sintering step S05).

The sintering step S05 is performed by maintaining the aluminum raw material for sintering 20 at 590° C. to 665° C. for 0.5 to 60 minutes in an inert gas atmosphere. Depending on the content amount of Mg in the aluminum raw material for sintering 20, the optimum sintering temperature differs. However, in order to permit high-strength and uniform sintering, the sintering temperature is set to 590° C., which is the liquidus-line temperature of Al—10 mass % Mg, or more. In addition, it is set to 665° C. or less in order to prevent rapid progression of sintering shrinkage due to combining of melts in the formed liquid phases. Preferably, the retention time is set to 1 to 20 minutes.

In the sintering step S05, the optimum temperature differs depending on the content amount of Mg in the aluminum raw material for sintering 20 as described above. However, sintering is performed by heating at the temperature of 590° C. to 665° C., which is close to the melting point of the aluminum substrate 11, in any case. Thus, the aluminum substrates 11 in the aluminum raw material for sintering 20 are melted. Since the oxide films are formed on the surfaces of the aluminum substrates 11, the melted aluminum is held by the oxide film; and the shapes of the aluminum substrates 11 are maintained.

Figure 6:
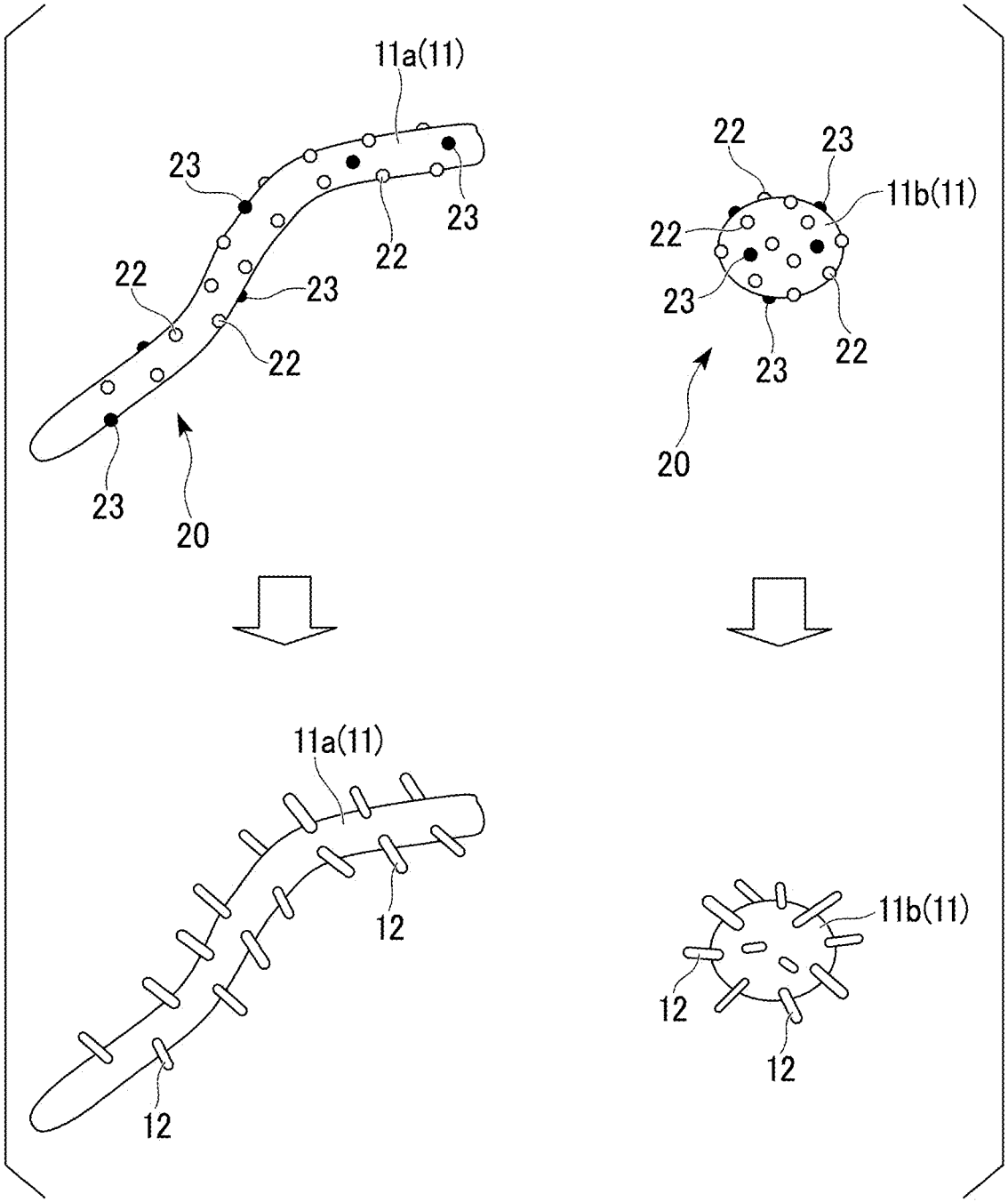
FIG. 6 is an explanatory diagram showing the state where the pillar-shaped protrusions are formed on the outer surfaces of the aluminum substrates in the step of sintering.

In addition, by being heated at 590° C. to 665° C., in the part where the titanium powder grains 22 are adhered among the outer surfaces of the aluminum substrates 11, the oxide files are destroyed by the reaction with titanium; and the melted aluminum inside spouts out. The spouted out melted aluminum forms a high-melting point compound by reacting with titanium to be solidified. Because of this, the pillar-shaped protrusions 12 projecting toward the outside are formed on the outer surfaces of the aluminum substrates 11 as shown in FIG. 6. On the tip of the pillar-shaped protrusion 12, the Ti—Al compound 16 exists. Growth of the pillar-shaped protrusion 12 is suppressed by the Ti—Al compound 16.

In the case where titanium hydride is used as the titanium powder grains 22, titanium hydride is decomposed near the temperature of 300° C. to 400° C.; and the produced titanium reacts with the oxide films on the surfaces of the aluminum substrates 11.

In addition, in the present embodiment, a part of the oxide films formed on the surfaces of the aluminum substrates is reduced by the magnesium powder grains 23 adhered on the outer surfaces of the aluminum substrates 11; and a large number of the pillar-shaped protrusions 12 are formed. More specifically, it is understood that it is because of thinning of the oxide films by: the magnesium powder grains 23 being sublimed to be dispersed in the oxide films; and reducing the oxide films At this time, the adjacent the aluminum substrates 11, 11 are bonded to each other by being combined integrally in a molten state or being sintered in a solid state through the pillar-shaped protrusions 12 of each. Accordingly, the porous aluminum sintered compact 10, in which the aluminum substrates 11, 11 are bonded to each other through the pillar-shaped protrusions 12 as shown in FIG. 1, is produced. In addition, the junction 15, in which the aluminum substrates 11, 11 are bonded to each other through the pillar-shaped protrusion 12, includes the Ti—Al compound 16 ($Al_3Ti$ intermetallic compound in the present embodiment) and the Mg oxide 17.

In the porous aluminum sintered compact 10 of the present embodiment configured as described above, the junction 15 of the aluminum substrates 11, 11 includes the Ti—Al compound 16. Thus, the oxide films formed on the surfaces of the aluminum substrates 11 are removed by the Ti—Al compound 16; and the aluminum substrates 11, 11 are bonded properly to each other. Therefore, the high-quality porous aluminum sintered compact 10 having sufficient strength can be obtained.

In addition, since the growth of the pillar-shaped protrusions 12 is suppressed by the Ti—Al compound 16, spouting out of the melted aluminum into the voids between the aluminum substrates 11, 11 can be suppressed; and the porous aluminum sintered compact 10 having high porosity can be obtained.

Especially, $Al_3Ti$ exists as the Ti—Al compound 16 in the junction 15 of the aluminum substrates 11, 11 in the present embodiment. Thus, the oxide films formed on the surfaces of the aluminum substrates 11 are removed reliably; and the aluminum substrates 11, 11 are bonded properly to each other. Therefore, strength of the porous aluminum sintered compact 10 can be ensured.

In addition, in the present embodiment, the junction 15 includes the Mg oxide 17. Thus, a part of the oxide films formed on the surfaces of the aluminum substrates 11 is reduced; and a large number of the junctions 15 of the aluminum substrates 11, 11 each other can be formed. Accordingly, strength of the porous aluminum sintered compact 10 can be improved significantly.

In addition, the porous aluminum sintered compact 10 has the structure in which the aluminum substrates 11, 11 are bonded to each other through the pillar-shaped protrusions 12 formed on the outer surfaces of the aluminum substrates 11. Thus, the porous aluminum sintered compact 10 having high porosity can be obtained without performing the step of foaming or the like separately. Therefore, the porous aluminum sintered compact 10 of the present embodiment can be produced efficiently at low cost.

Especially, the continuous sintering apparatus 30 is used in the present embodiment. Thus, the sheet-shaped porous aluminum sintered compact 10 can be produced continuously; and the production efficiency can be improved significantly.

Moreover, the content amount of the binder is extremely low compared to the viscous compositions in the present embodiment. Thus, the binder removing step S04 can be performed in a short time. In addition, the shrinkage rate during sintering becomes about 1%, for example; and the porous aluminum sintered compact 10 having excellent dimensional accuracy can be obtained.

In addition, the aluminum fibers 11*a* and the aluminum powder 11*b* are used as the aluminum substrates 11 in the present embodiment. Thus, the porosity of the porous aluminum sintered compact 10 can be controlled by adjusting the mixing rates.

In addition, the porosity is set to the range of 30% or more and 90% or less in the porous aluminum sintered compact 10 of the present embodiment. Thus, it is possible to provide the porous aluminum sintered compact 10 having an optimal porosity depending on the application.

In addition, the content amount of the titanium powder grains 22 in the aluminum raw material for sintering 20 is set to 0.01 mass % or more and 20 mass % or less in the present embodiment. Thus, the pillar-shaped protrusions 12 can be formed with an appropriate distance therebetween on the outer surfaces of the aluminum substrates 11. Accordingly, the porous aluminum sintered compact 10 having sufficient strength and high porosity can be obtained.

In addition, the distance between the titanium powder grains 22, 22 each other adhered on the outer surfaces of the aluminum substrates 11 is set to the range of 5 μm or more and 100 μm or less in the present embodiment. Thus, the distance between the pillar-shaped protrusions 12 is set appropriately. Accordingly, the porous aluminum sintered compact 10 having sufficient strength and high porosity can be obtained.

In addition, the content amount of the magnesium powder grains 23 in the aluminum raw material for sintering 20 is set to 0.01 mass % or more and 5 mass % or less in the present embodiment. Thus, by reducing the oxide films on the surfaces of the aluminum substrates 11 at an appropriate extent, a large number of the pillar-shaped protrusions 12 can be formed with an appropriate distance therebetween. Accordingly, the porous aluminum sintered compact 10 having sufficient strength and high porosity can be obtained.

In addition, the fiber diameter of the aluminum fiber 11*a*, which is the aluminum substrate 11, is set to the range of 40 μm or more and 500 μm or less; and the grain size of the aluminum powder 11*b* is set to the range of 20 μm or more and 300 μm or less in the present embodiment. In addition, the grain size of the titanium powder grains 22 is set to the range of 1 μm or more and 50 μm or less; and the grain size of the magnesium powder grains 23 is set to the range of 20 μm or more and 150 μm or less. Therefore, the titanium powder grains 22 and the magnesium powder grains 23 are dispersedly adhered on the outer surfaces of the aluminum substrates 11 (the aluminum fibers 11*a* and the aluminum powder 11*b*) reliably.

In addition, the aluminum fibers 11*a* and the aluminum powder 11*b* are used as the aluminum substrates 11; and the ratio of the aluminum powder 11*b* relative to the aluminum substrates 11 is set to 15 mass % or less in the present embodiment. Thus, the porous aluminum sintered compact 10 with high porosity can be obtained.

Another method of producing the porous aluminum sintered compact is described below.

For example, the aluminum fibers 11*a*; and any one or both of the Mg powder and Mg alloy powder 23, are mixed at room temperature. During mixing, a binder solution is sprayed on. As the binder, what is burned and decomposed during heating at 500° C. in the air is preferable. More specifically, using an acrylic resin or a cellulose-based polymer material is preferable. In addition, various solvents such as the water-based, alcohol-based, and organic-based solvents can be used as the solvent of the binder.

During mixing, the aluminum fibers 11*a* and the Mg powder 23 are mixed by various mixing machine, such as an automatic mortar, a pan type rolling granulator, a shaker mixer, a pot mill, a high-speed mixer, a V-shaped mixer, and the like, while they are fluidized.

Next, by drying the mixture obtained by mixing, the Mg powder and the Mg alloy powder 23 are dispersedly adhered on the outer surfaces of the aluminum fibers 11*a*; and the aluminum raw material for sintering 20 in the present embodiment is produced.

Next, during producing the porous aluminum sintered compact 10 by using the aluminum raw material for sintering 20 obtained as described above, the porous aluminum sintered compact 10 in the long sheet shape of: 300 mm of width; 1-5 mm of thickness; and 20 m of length, is produced, for example, by using a continuous sintering apparatus or the like for example.

For example, the aluminum raw material for sintering 20 is spread toward the upper surface of the carbon sheet from a raw material spreading apparatus; the aluminum raw material for sintering 20 is stacked; and the aluminum raw material for sintering 20 stacked on the carbon sheet is shaped into a sheet-shape. At this time, voids are formed between the aluminum fibers 11*a* in the aluminum raw material for sintering 20.

At this time, for example, the aluminum fibers 11*a* are stacked in such a way that the bulk density after filling becomes 50% of the true density of the aluminum fibers to maintain three-dimensional and isotropic voids between the aluminum fibers 11*a* in stacking.

Next, the aluminum raw material for sintering 20, which is shaped into the sheet-shape on the carbon sheet, is inserted in the degreasing furnace; and the binder is removed by being heated at a predetermined temperature. At this time, the aluminum raw material for sintering is maintained at 350° C. to 500° C. for 0.5 to 5 minutes in the air atmosphere; and the binder in the aluminum raw material for sintering is removed. In the present embodiment, the binder is used only for adhering the Mg powder and the Mg alloy powder 23 on the outer surfaces of the aluminum fibers 11*a*. Thus, the content amount of the binder is extremely low compared to the viscous compositions; and the binder can be removed sufficiently in a short time.

Next, the aluminum raw material for sintering 20 free of the binder is inserted in the sintering furnace with the carbon sheet and sintered by being heated at a predetermined temperature.

The sintering is performed by maintaining the aluminum raw material for sintering at 590° C. to 665° C. for 0.5 to 60 minutes in an inert gas atmosphere, for example. Depending on the content amount of Mg in the aluminum raw material for sintering 20, the optimum sintering temperature differs. However, in order to permit high-strength and uniform sintering, the sintering temperature is set to 590° C., which is the liquidus-line temperature of Al—10 mass % Mg, or more. In addition, it is set to 665° C. or less in order to prevent rapid progression of sintering shrinkage due to combining of melts in the formed liquid phases. Preferably, the retention time is set to 1 to 20 minutes.

In the sintering, a part of the aluminum fibers 11*a* in the aluminum raw material for sintering 20 is melted. However, since the oxide films are formed on the surfaces of the aluminum fibers 11*a*, the melted aluminum is held by the oxide film; and the shapes of the aluminum fibers 11*a* are maintained.

In the part where the Mg powder grains, the Mg alloy powder grains 23 are adhered among the outer surfaces of the aluminum fibers 11*a*, Mg functions as a reducing agent for the oxide films of $Al_2O_3$; the oxide films are destroyed; and formation of sintered bonding is stimulated. In addition, by Mg, which is adhered on the surfaces of the aluminum fibers, reacting locally with the aluminum fibers, the melting point lowering effect is obtained locally in the vicinity of the adhering parts. As a result, the liquid phase is formed at an even lower temperature than the melting point of the pure aluminum fibers or the aluminum alloy fibers; and sintering is stimulated to improve strength compared to the case free of Mg addition.

Since Mg diffuses into the aluminum fibers gradually with progression of sintering, Mg exists in solid solution or in the form of Mg oxide in the finally obtained porous aluminum sintered compact.

Embodiments of the present invention are explained above. However, the present invention is not particularly limited by the description of the embodiments; and the present invention can be modified as need in the range that does not depart from the technical concept of the present invention as defined in the scope of the present invention.

For example, it is explained that the porous aluminum sintered compact is continuously produced by using the continuous sintering apparatus shown in FIG. 5.

However, the present invention is not limited by the description, and the porous aluminum sintered compact may be produced by using other producing apparatus In addition, the sheet-shaped porous aluminum sintered compacts are explained in the present embodiment. However, the present invention is not particularly limited by the description, and it may be the bulk-shaped porous aluminum sintered compact produced by the production process shown in FIG. 7, for example.

Figure 7:
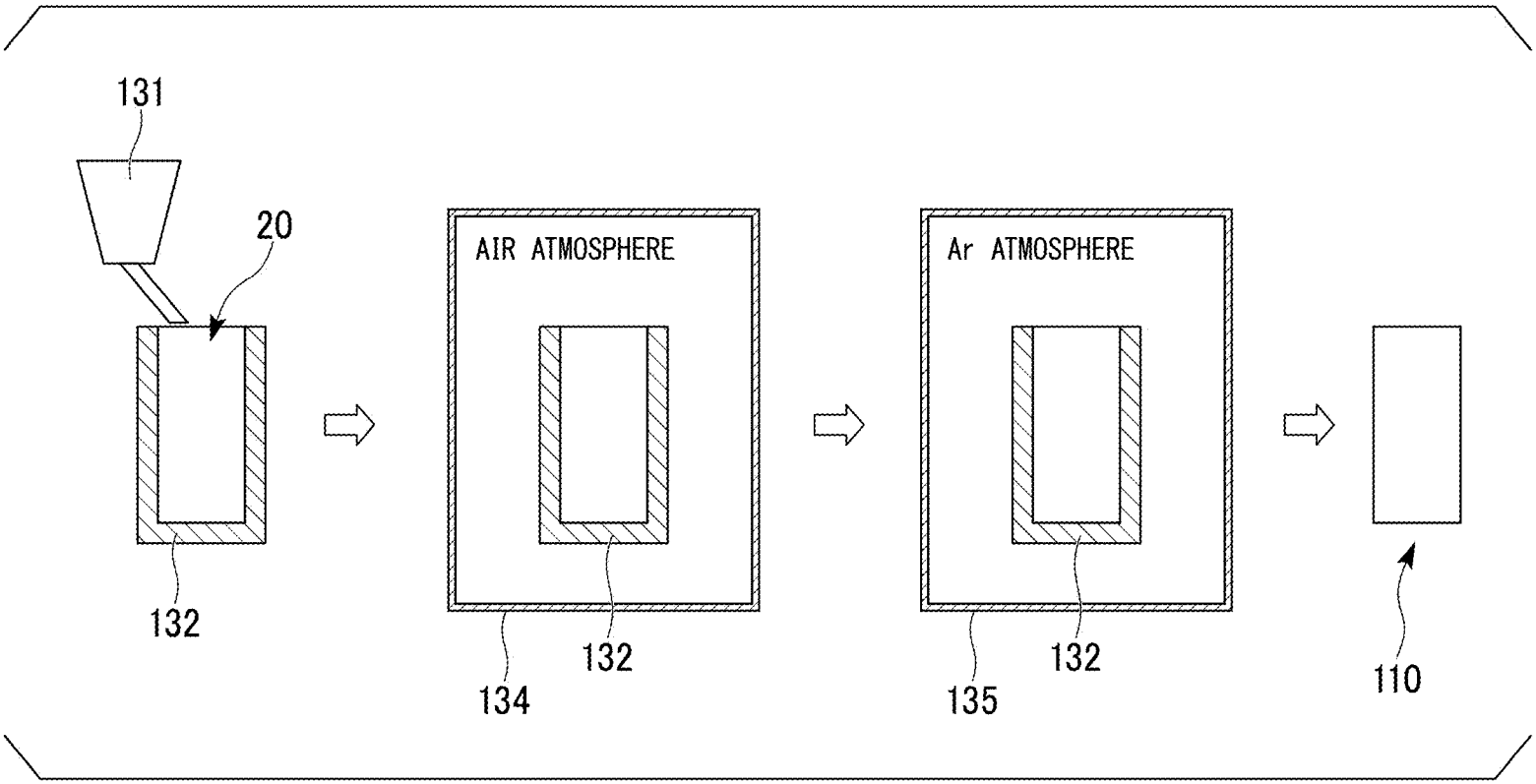
FIG. 7 is an explanatory diagram showing the production process for producing the porous aluminum sintered compact in a bulk-shape.

As shown in FIG. 7, the aluminum raw material for sintering 20 is spread to bulk fill (the raw material spreading step) on the carbon-made container 132 from the powder spreader 131 spreading the aluminum raw material for sintering 20. Then, the container 132 is inserted in the degreasing furnace 134; and the binder is removed by heating under air atmosphere (the binder removing step). Then, the container is inserted in the sintering furnace 135; and heated to and retained at 590° C. to 665° C. under an Ar atmosphere to obtain the bulk-shaped porous aluminum sintered compact 110. The bulk-shaped porous aluminum sintered compact 110 can be taken out from the carbon-made container 132 relatively easily, since a carbon-made container having excellent mold releasing characteristics is used as the carbon-made container 132; and the content is shrunk in the shrinkage rate about 1% during sintering.

EXAMPLES

Results of confirmatory experiments performed to confirm the technical effect of the present invention are explained below.

By the methods shown in the above-described embodiments and using the raw materials shown in Table 1, the aluminum raw materials for sintering were prepared. The aluminum fibers, the fiber diameter of which was 40 μm or more and 500 μm or less; and the aluminum powder, the grain size of which was 20 μm or more and 300 μm or less, were used as the aluminum substrates By the production methods shown in the above-described embodiments and using these aluminum raw materials for sintering, the porous aluminum sintered compacts having the dimension of: 30 mm of width; 200 mm of length; and 5 mm of thickness, were produced. More specifically, the sintering step was performed in the condition of: in the highly-pure argon atmosphere; at a sintering temperature appropriately selected based on each of aluminum raw materials between 590° C. to 655° C.; and the retention time of 15 minutes for each.

With respect to the obtained porous aluminum sintered compacts, the apparent porosity and the tensile strength were evaluated. The evaluation results are shown in Table 1. The evaluation methods are shown below.

[Apparent Porosity]

The mass m (g), the volume V ($cm^3$), and the true density d ($g/cm^3$) were measured in the obtained porous aluminum sintered compacts; and the apparent porosity was calculated by suing the formula shown below.

$$\text{Apparent Porosity } (\%)=(1-(m/(V\times d)))\times 100$$

The true density ($g/cm^3$) was measured by the water method with the precision balance.

[Tensile Strength]

The tensile strength of the obtained porous aluminum sintered compacts was measured by the pulling method.

[Metal Structure of the Junction]

Identification and distribution state of the Ti—Al compound and the Mg oxide in the junction were obtained by the energy dispersive X-ray spectroscopy (EDX method) or the electron micro analyzer (EPMA method).

TABLE 1

| | | Aluminum substrate | | | Titanium powder | | | Magnesium powder | | | | |
|---|---|---|---|---|---|---|---|---|---|---|---|---|
| | | Material | Fiber (%) | Powder (%) | Material | Grain size (μm) | Content amount (mass %) | Grain size (μm) | Content amount (mass %) | Sintering temperature (° C.) | Apparent porosity (%) | Tensile strength (N/mm$^2$) |
| Examples of the present invention | 1 | A1070 | 94.0 | — | Titanium hydride | 1.0 | 5.0 | 30.0 | 1.0 | 630 | 74.2 | 3.5 |
| | 2 | A1070 | 94.0 | — | Titanium hydride | 5.0 | 5.0 | 30.0 | 1.0 | 645 | 72.0 | 3.1 |
| | 3 | A1070 | 94.0 | — | Metal titanium | 30.0 | 5.0 | 30.0 | 1.0 | 645 | 73.2 | 2.8 |
| | 4 | A1070 | 94.0 | — | Metal titanium | 50.0 | 5.0 | 30.0 | 1.0 | 630 | 75.0 | 2.5 |
| | 5 | A1070 | 98.99 | — | Titanium hydride | 5.0 | 0.01 | 30.0 | 1.0 | 635 | 74.0 | 1.5 |
| | 6 | A1070 | 79.0 | — | Titanium hydride | 5.0 | 20.0 | 30.0 | 1.0 | 640 | 70.6 | 2.8 |
| | 7 | A1070 | 94.0 | — | Titanium hydride | 5.0 | 5.0 | 20.0 | 1.0 | 640 | 74.3 | 3.4 |
| | 8 | A1070 | 94.0 | — | Titanium hydride | 5.0 | 5.0 | 75.0 | 1.0 | 640 | 74.0 | 3.0 |
| | 9 | A1070 | 94.99 | — | Titanium hydride | 5.0 | 5.0 | 30.0 | 0.01 | 655 | 73.0 | 2.5 |
| | 10 | A1070 | 90.0 | — | Titanium hydride | 5.0 | 5.0 | 30.0 | 5.0 | 645 | 71.5 | 3.6 |
| | 11 | A1070 | 89.0 | 5.0 | Titanium hydride | 5.0 | 5.0 | 30.0 | 1.0 | 650 | 69.2 | 2.9 |
| | 12 | A1070 | 84.0 | 10.0 | Titanium hydride | 5.0 | 5.0 | 30.0 | 1.0 | 655 | 68.5 | 3.2 |
| | 13 | A1050 | 96.0 | — | Titanium hydride | 5.0 | 0.5 | 30.0 | 3.5 | 655 | 56.5 | 7.0 |
| | 14 | A1050 | 96.0 | — | Titanium hydride | 5.0 | 2.0 | 50.0 | 2.0 | 645 | 60.1 | 4.9 |
| | 15 | A1050 | 97.3 | — | Titanium hydride | 5.0 | 2.0 | 30.0 | 0.7 | 650 | 65.5 | 4.1 |
| | 16 | A1050 | 93.5 | — | Titanium hydride | 5.0 | 5.0 | 30.0 | 1.5 | 640 | 69.3 | 3.7 |
| | 17 | A1050 | 94.0 | — | Titanium hydride | 5.0 | 5.0 | 30.0 | 1.0 | 630 | 74.6 | 2.1 |
| | 18 | A1050 | 85.5 | — | Titanium hydride | 5.0 | 10.0 | 20.0 | 4.5 | 600 | 83.7 | 1.3 |
| | 19 | A3003 | 98.5 | — | Titanium hydride | 10.0 | 1.0 | 30.0 | 0.5 | 620 | 60.3 | 4.4 |
| | 20 | A3003 | 94.0 | — | Titanium hydride | 5.0 | 5.0 | 30.0 | 1.0 | 605 | 70.4 | 2.4 |
| | 21 | A3003 | 84.0 | — | Titanium hydride | 5.0 | 12.0 | 20.0 | 4.0 | 595 | 82.6 | 1.5 |
| | 22 | A5052 | 98.7 | — | Titanium hydride | 10.0 | 1.0 | 30.0 | 0.3 | 630 | 59.0 | 6.4 |
| | 23 | A5052 | 93.5 | — | Titanium hydride | 5.0 | 5.0 | 30.0 | 1.5 | 600 | 68.8 | 4.2 |
| | 24 | A5052 | 84.5 | — | Titanium hydride | 5.0 | 12.0 | 20.0 | 3.5 | 590 | 80.5 | 1.7 |
| Comparative Example 1 | | A1070 | 80.0 | — | Titanium hydride | 5.0 | 20.0 | — | — | 660 | 70.2 | 0.5 |
| Comparative Example 2 | | A1070 | 100.0 | — | — | — | — | — | — | 662 | 75.0 | 0.1 |

In Examples 1 to 24 of the present invention, in which the aluminum raw materials including the magnesium powders were used, it was confirmed that strength was improved sufficiently even though they had apparent porosities equivalent to Comparative Examples 1 and 2, in which the aluminum raw materials free of the magnesium powder were used as shown in Table 1.

Based on the observation, it was confirmed that the high-quality porous aluminum sintered compact having high porosity and sufficient strength could be provided according to the present invention.

REFERENCE SIGNS LIST

10, 110: Porous aluminum sintered compact
11: Aluminum substrate
11*a*: Aluminum fiber
11*b*: Aluminum powder
12: Pillar-shaped protrusion
15: Junction
16: Ti—Al compound
17: Mg oxide
20: Aluminum raw material for sintering
22: Titanium powder grain (Titanium powder)
23: Magnesium powder grain (Magnesium powder)

What is claimed is:

1. A porous aluminum sintered compact comprising a plurality of aluminum substrates sintered to each other, wherein a junction, in which the plurality of aluminum substrates are bonded to each other, includes a Ti—Al compound and a Mg oxide, the plurality of aluminum substrates are made of aluminum fibers or both of aluminum fibers and an aluminum powder, a ratio of the aluminum powder in the plurality of aluminum substrates is 15 mass % or less, a plurality of pillar-shaped protrusions projecting toward an outside are formed on outer surfaces of the plurality of aluminum substrates, the pillar-shaped protrusions include the junction, a porosity of the porous aluminum sintered compact is in a range of 56.5% or more and less than 90%, and the aluminum fibers are subjected to a shape-added processing which is a torsion processing.

2. A method of producing the porous aluminum sintered compact according to claim 1, the method comprising the steps of:

forming an aluminum raw material for sintering by adhering a titanium powder, which is made of any one of or both of a titanium metal powder and a titanium hydride powder, and a magnesium powder on outer surfaces of the plurality of aluminum substrates;

spreading the aluminum raw material for sintering on a holder; and sintering the aluminum raw material held on the holder by heating, wherein the plurality of aluminum substrates are bonded through a junction including a Ti—Al compound and the a Mg oxide.

3. The method of producing the porous aluminum sintered compact according to claim 2, wherein the junction is formed on a plurality of pillar-shaped protrusions projecting toward an outside from outer surfaces of the plurality of aluminum substrates.

4. The method of producing the porous aluminum sintered compact according to claim 2, wherein a content amount of the titanium powder in the aluminum raw material for sintering is set in a range of 0.01 mass % or more and 20 mass % or less, and a content amount of the magnesium powder in the aluminum raw material for sintering is set in a range of 0.01 mass % or more and 5 mass % or less in the step of forming an aluminum raw material for sintering.

5. The method of producing the porous aluminum sintered compact according to claim 2, wherein the step of forming an aluminum raw material for sintering comprises the steps of:

mixing the plurality of aluminum substrates; and the titanium powder and the magnesium powder in a presence of a binder; and drying a mixture obtained in the step of mixing.

* * * * *